US006865857B1

(12) United States Patent
Adell Argiles

(10) Patent No.: US 6,865,857 B1
(45) Date of Patent: Mar. 15, 2005

(54) INTEGRAL REINFORCING SYSTEM FOR MASONRY WALLS

(76) Inventor: Josep Maria Adell Argiles, Paseo de la Castellana, 154-28020, Madrid (ES)

( * ) Notice: Subject to any disclaimer, the term of this patent is extended or adjusted under 35 U.S.C. 154(b) by 85 days.

(21) Appl. No.: 09/655,188

(22) Filed: Sep. 5, 2000

Related U.S. Application Data

(63) Continuation of application No. 09/024,664, filed on Feb. 17, 1998, now abandoned.

(30) Foreign Application Priority Data

Feb. 14, 1997 (ES) ..... P9700309

(51) Int. Cl.[7] ..... E04B 1/38

(52) U.S. Cl. ..... 52/703; 52/379; 52/426; 52/427; 52/428; 52/431; 52/432; 52/564; 52/565; 52/568; 52/570; 52/715

(58) Field of Search ..... 52/600, 602, 583.1, 52/586.1, 586.2, 587.1, 585.1, 701, 703, 712, 714, 715, 378, 379, 435, 432, 698, 699, 426–428, 431, 442, 677, 686, 564, 565, 568, 570

(56) References Cited

U.S. PATENT DOCUMENTS 1,768,157 A * 6/1930 Shelden
3,257,767 A * 6/1966 Lassy
4,391,077 A * 7/1983 Giess ..... 52/747
5,231,815 A * 8/1993 Colen ..... 52/438
5,351,457 A * 10/1994 Colen ..... 52/438
5,829,217 A * 11/1998 Colen ..... 42/442
6,014,849 A * 1/2000 Yonemura ..... 52/586.1
6,189,282 B1 * 2/2001 Vander Werf ..... 52/582.1

* cited by examiner

*Primary Examiner*—Carl D. Friedman
*Assistant Examiner*—Yvonne M. Horton
(74) *Attorney, Agent, or Firm*—Reed Smith LLP

(57) ABSTRACT

A vertical reinforcement for masonry wall comprising a void reinforcement within a vertical housing within the wall placed through vertical access grooves. The grooves may be opened on the unexposed face of the masonry wall and served for the accurate positioning of the longitudinal reinforcement within the full width of the wall. In addition to the longitudinal reinforcement, the system also includes fixed or moveable transverse connectors or spacers which supplement the reinforcement; lateral or end anchorages to secure the reinforcement and by way of suitable supports, the wall itself; and supplementary elements which may be retention anchors, plum and leveling lines and support sections set for the overhanging masonry base.

3 Claims, 14 Drawing Sheets

INTEGRAL REINFORCING SYSTEM FOR MASONRY WALLS

This is a continuation of a application Ser. No. 09/024,664, filed Feb. 17, 1998, now abandoned.

OBJECT OF THE INVENTION

The present invention provides a system of reinforcement for masonry, particularly with regards to the vertical reinforcement of the wall. The system involves reinforcement set in housing or channels provided within the wall and this reinforcement together with its corresponding anchorage and components may be used as framework or formwork in order to form an integral system which, in accordance with the established design theory, is always set in the precise position to allow the wall to work effectively in accordance with the design values of stress for the construction.

This integral reinforcing system is applicable to all types or masonry and does not affect the properties of the wall in those areas which do not require reinforcing, and will in no way affect the exposed face of the wall.

BACKGROUND OF THE INVENTION

The applicant is the patent holder of invention 9501891 for an "Building unit for integral masonry". This system provides masonry walls with vertical channelling or voids of a suitable size which are connected through the unexposed face of the wall. Once the corresponding lateral access channel to the centre of the piece has been opened the reinforcement may easily be inserted within the masonry either during or after construction. This reinforcing system in no way affects the classical bond on the masonry which is necessary to ensure the wall's stability.

However, this patent does not cover certain significant aspects related to bricklaying techniques, and specifically that regarding: the form of the prefabricated void reinforcement; the anchors and supplementary components necessary for an integral reinforcing system and which ensure quick, simple and efficient construction; and the correct positioning and spacing of the void reinforcement with regard to the two faces of the wall.

DESCRIPTION OF THE INVENTION

The integral reinforcing system proposed by this invention effectively covers the requirements indicated above and, as such, is focused on the void reinforcement, the anchors for the same and the series of supplementary elements.

The void reinforcement may be applied to different types of reinforced masonry, namely.

Reinforced masonry.

Pre-stressed masonry.

Post-stressed masonry.

Hanging masonry.

Due to the special prefabricated nature of the said void reinforcement and its positioning, this reinforcement may also serve as guide frame within the masonry, which is accessible from the unexposed face of the wall (or the exposed face if so required), and which may be used to hold certain types of anchors and/or connectors. Indeed, these connectors could also be fitted to the free ends (upper and lower) of the said void reinforcement.

Once the anchors are fixed to the void reinforcement they may be then used to serve the following functions, to name but a few:

Fix the facing wall to a structural support.

Attach secondary elements to the supporting wall.

Attach various elements such as capping, angles, plumb lines, etc.

Any of these new possibilities could be considered for walls which are constructed in-situ or for walls which are prefabricated either on site or in workshop.

The void reinforcement is made up of one or several, individual or grouped longitudinal elements set parallel to each other at constant distances and joined by separators and spacers which may or may not be incorporated as part of the prefabricated component. These separators and spacers retain the parallel form of the reinforcement for the purposes of handling and its vertical placement within the wall near to both masonry faces during the construction.

The void reinforcement and anchors are designed to perform satisfactorily whether embedded in mortar, concrete, adhesives or cement glue and may even be placed completely or partially "free" of any binding material.

The void reinforcement and the connectors usually form an integral and resistant framework which may be suitably placed within the wall by the bricklayer. However, sometimes these two components may be fixed together by hand either before being placed in the wall or once the vertical reinforcement has been placed in the wall.

The anchors, as opposed to these transverse pieces and/or separators, are designed as a separate item which are fixed by hand by the bricklayer at a specific height in accordance with the characteristics of the item to support and/or be supported. These anchors could also be designed with a certain capacity for sliding movement up or down the vertical guide of the void reinforcement.

Finally, the supplementary components, while apparently of a secondary nature, may often form an essential part of the system if it is to work correctly.

DESCRIPTION OF THE FIGURES

A set of figures are enclosed in order to complement the description of the system and to offer a better understanding of the characteristics of the invention when employed according to design. These figures while forming an integral part of this description should be taken to be illustrative and not limited to these alone. These figures indicate the following.

PREFERRED EMBODIMENT OF THE INVENTION

Figure 1:
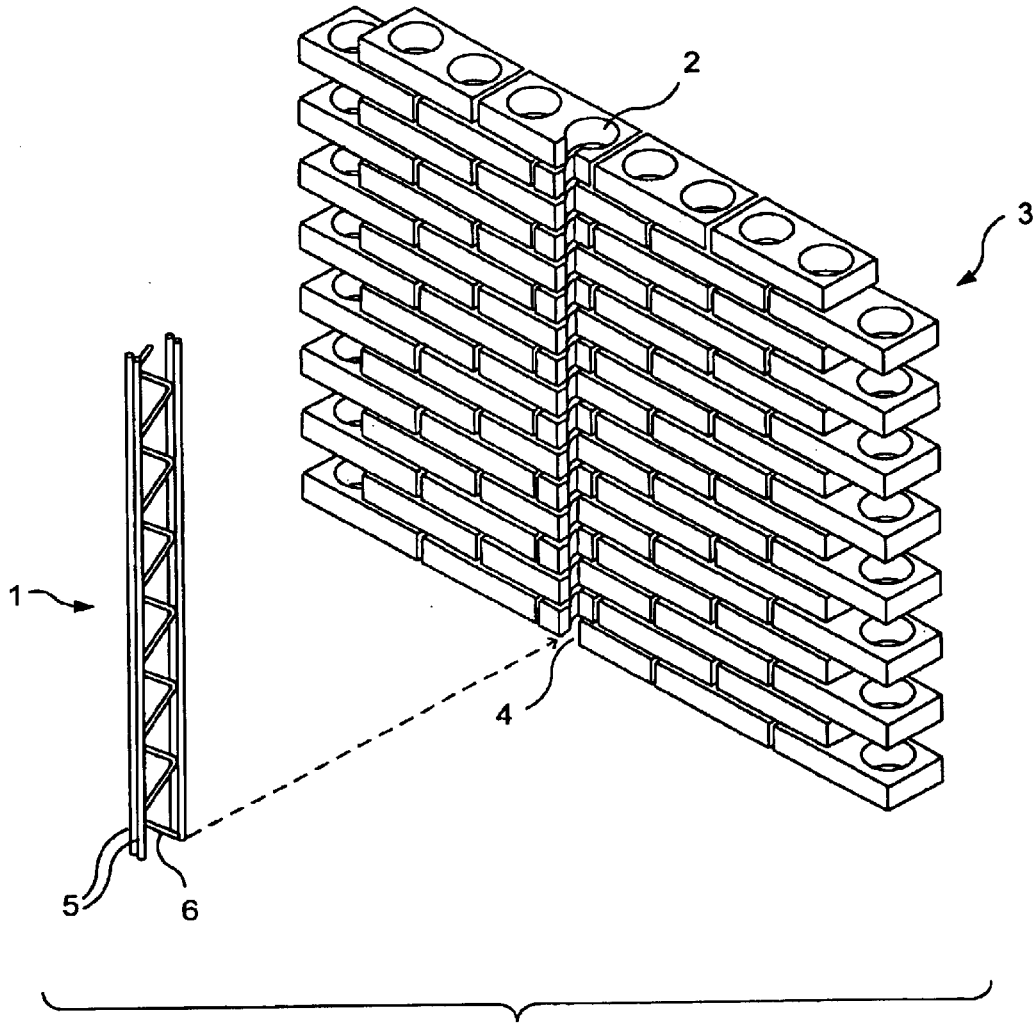
FIG. 1.—This figure shows a perspective of prefabricated void reinforcement set in front of the corresponding masonry wall, prior to reinforcement, in accordance with the system described in the present invention.

From these figures, and particularly FIG. 1, it may be seen how the void reinforcement (1) is housed in vertical voids (2) set within the masonry wall (3), the access to these voids (2) being made through lateral grooves (4) opened on the unexposed face of the wall (3).

Figure 2:
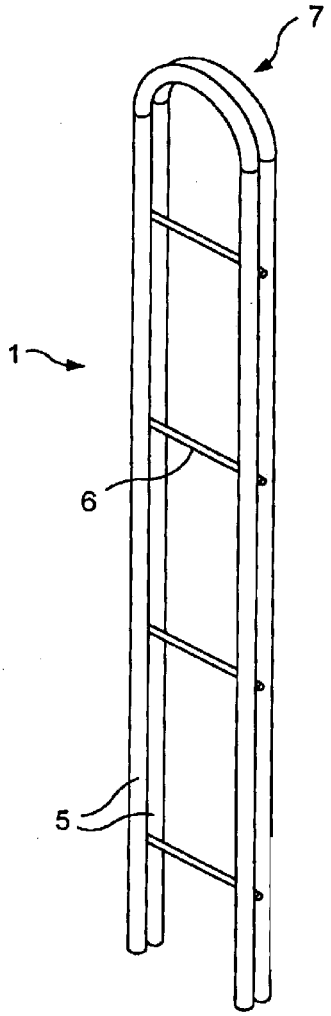
FIG. 2.—This figure shows a perspective of other types of void reinforcement which may be employed within the system described in the present invention.
Figure 3:
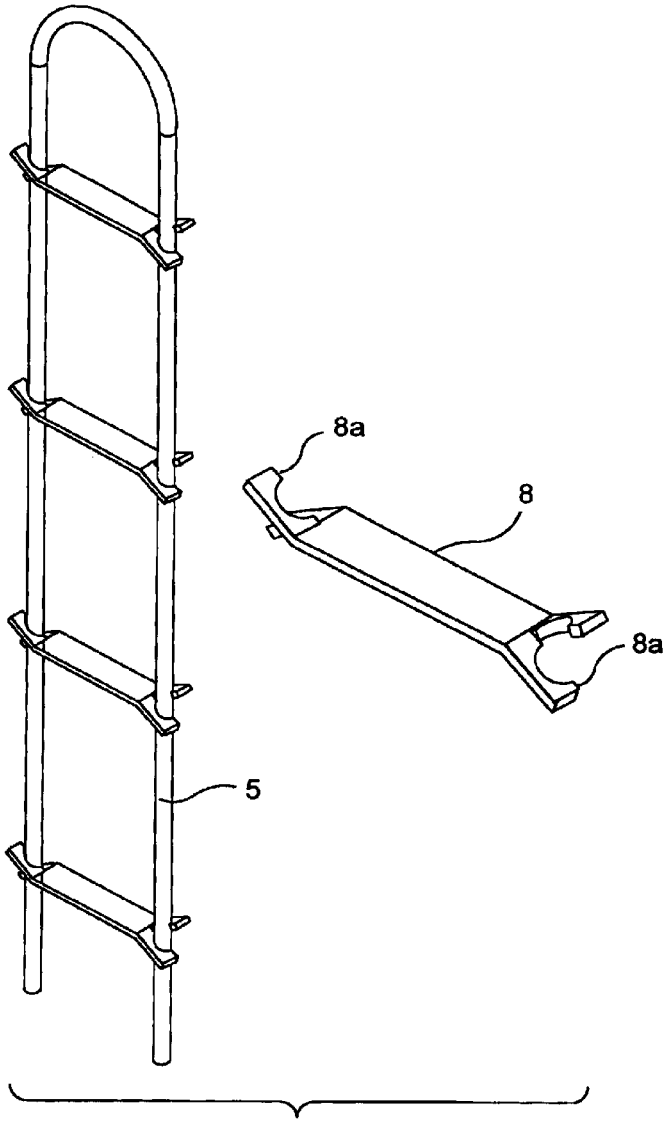
FIG. 3.—This shows a detail in perspective of one of the connectors which may be used in the void reinforcement.

The said reinforcement (1) may be formed by parallel longitudinal bars (5) which are suitably spaced and joined by connectors (6) which may be laid out in the zigzag form shown in FIG. 1, and with double longitudinal bars (5) or single bars. These connectors may be eliminated when the length of the reinforcement is very short, the bars may be joined together by a curved end piece (7) as shown in FIG. 2, moveable connectors (a) may be employed as shown in FIG. 3 and placed by the bricklayer himself, these latter connectors, which are manually fixed to the wall reinforcement, are made from plate angled at each end, a longitudinal cut being made in each angle and the sections turned asymmetrically and notched to adapt to the parallel and longitudinal wires or bars (1).

Figure 4:
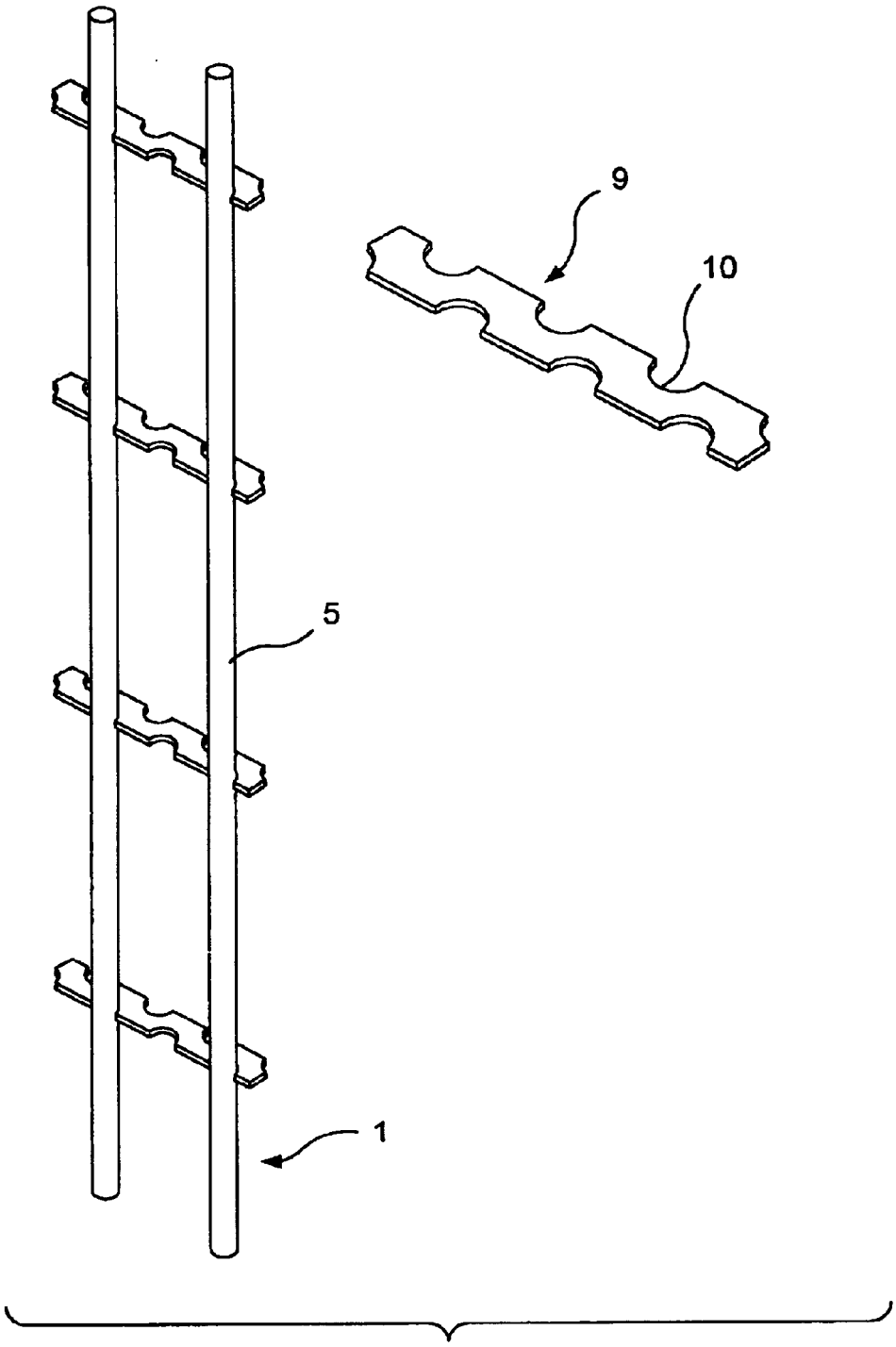
FIG. 4.—Shows a perspective of another type of connector which may be fixed to the corresponding reinforcement.

These said moveable connectors may also take the form of that indicated by (9) in FIG. 4 where a longitudinal plate is provided with semi-circular notches (10) which are designed to slot onto the main reinforcing bars (5).

The connectors may be joined within the same plane of the vertical reinforcement or on the sides of the same.

Figure 5:
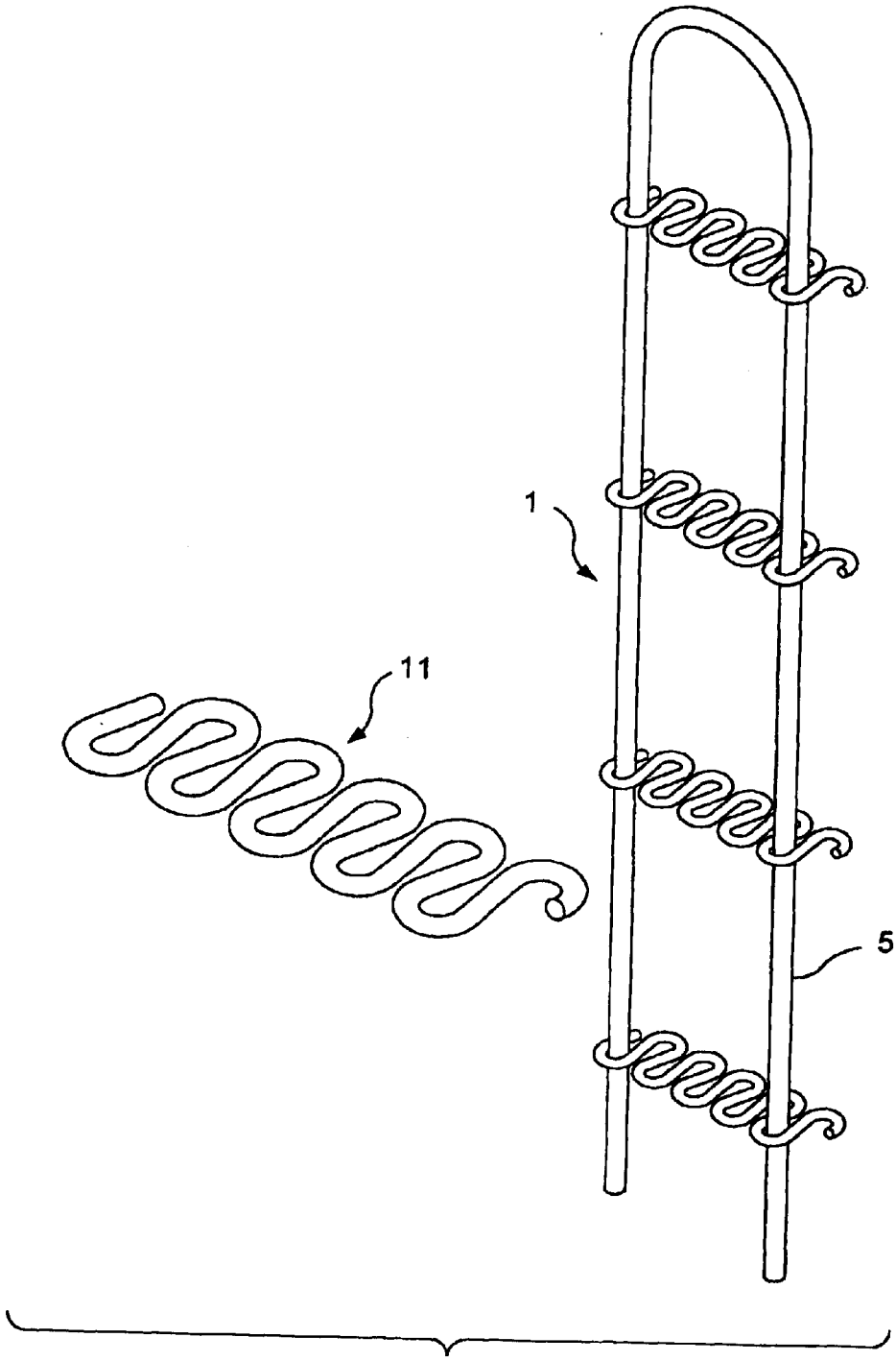
FIG. 5.—Shows the perspective of a further solution with regards to reinforcement connectors.

The connectors (11) may also be formed in a continuous strip which is then separated by the bricklayer, as in the form of the sinuously shaped rod shown in FIG. 5, which is subsequently split up into suitable lengths to suit the spacing of the reinforcing bars.

Figure 6A:
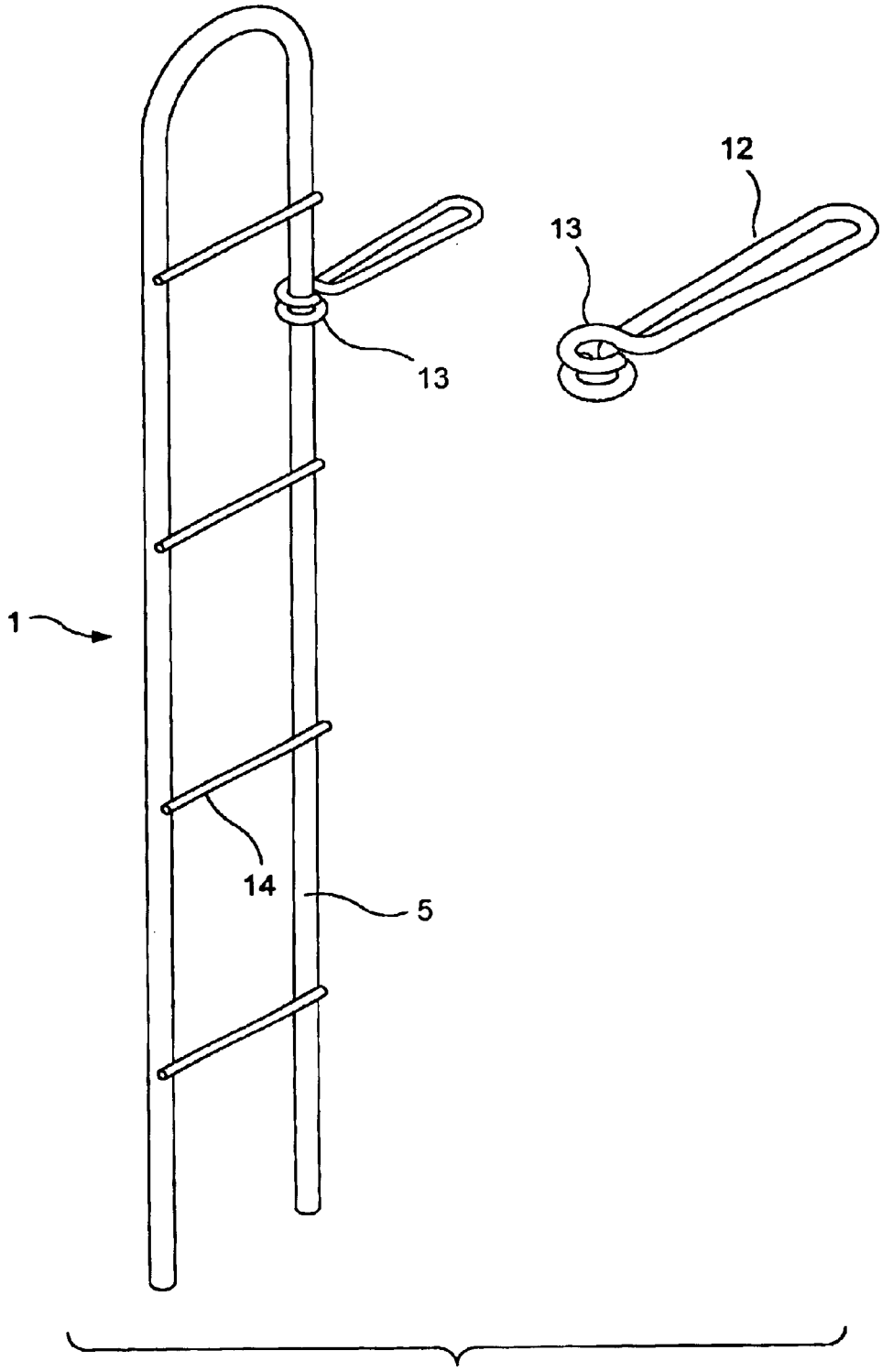
FIG. 6*a*.—Shows one of the lateral anchors which has been suitably fixed to the corresponding reinforcement.
Figure 6B:
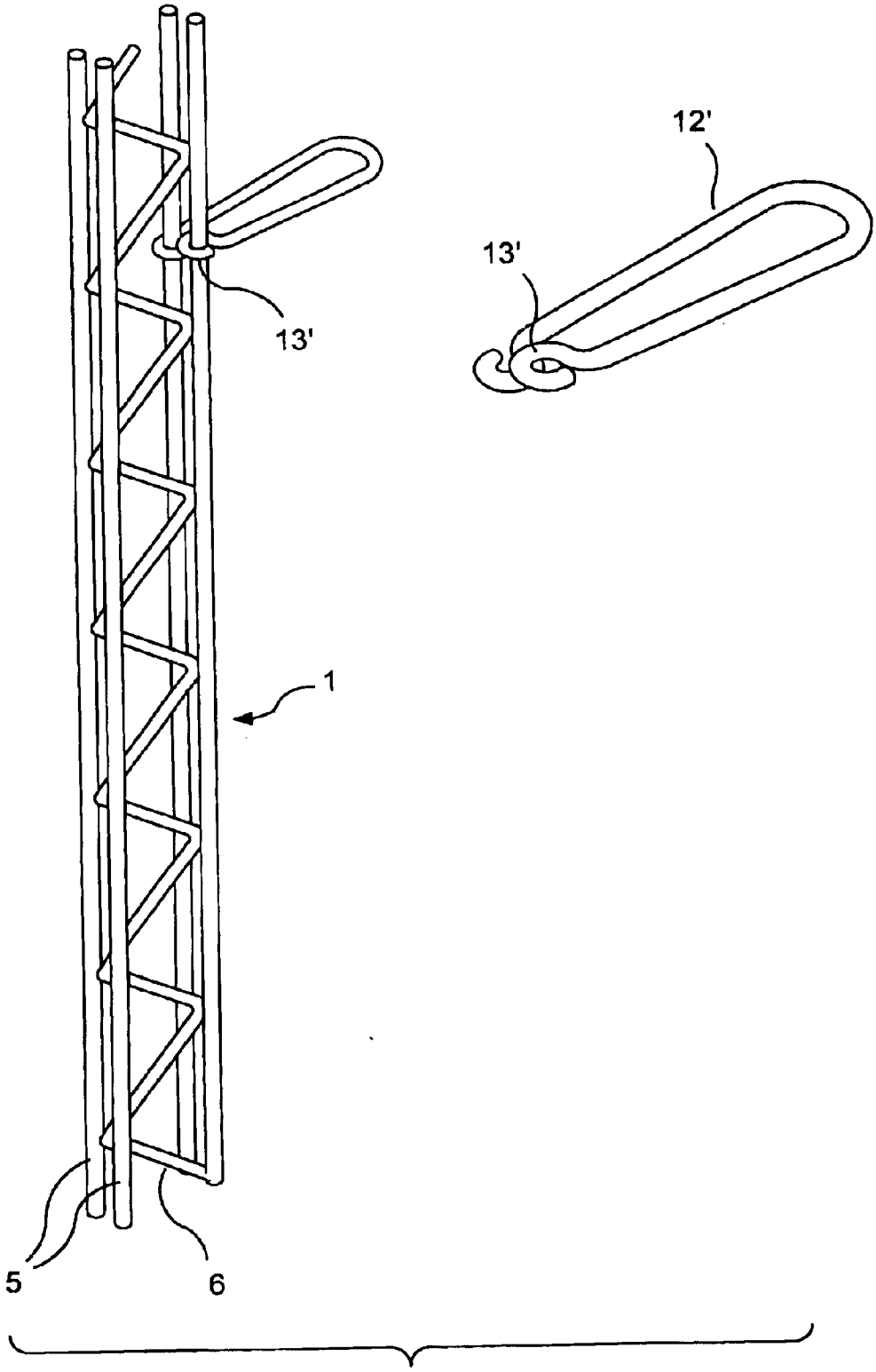
FIG. 6*b*.—Shows in perspective a further example of a lateral anchor, in this case employed with a different type of reinforcement.

The main reinforcement is also held by lateral anchors, indicated by (12) in FIG. 6*a*, which are made of flexible rod with asymmetrical hooks at each end (13) which may be fastened around the corresponding bar (5) of the reinforcement (1), it being possible to stiffen this reinforcement by means of the connectors (14) shown in the said FIG. 6*a* or by any of the aforementioned connectors. In the case where the reinforcement (1) is made up of double bars (5), as shown in FIG. 6*b*, each hook (13') on the lateral anchor (12') being fastened to one of the two side bars (5) forming the reinforcement (1).

Figure 7A:
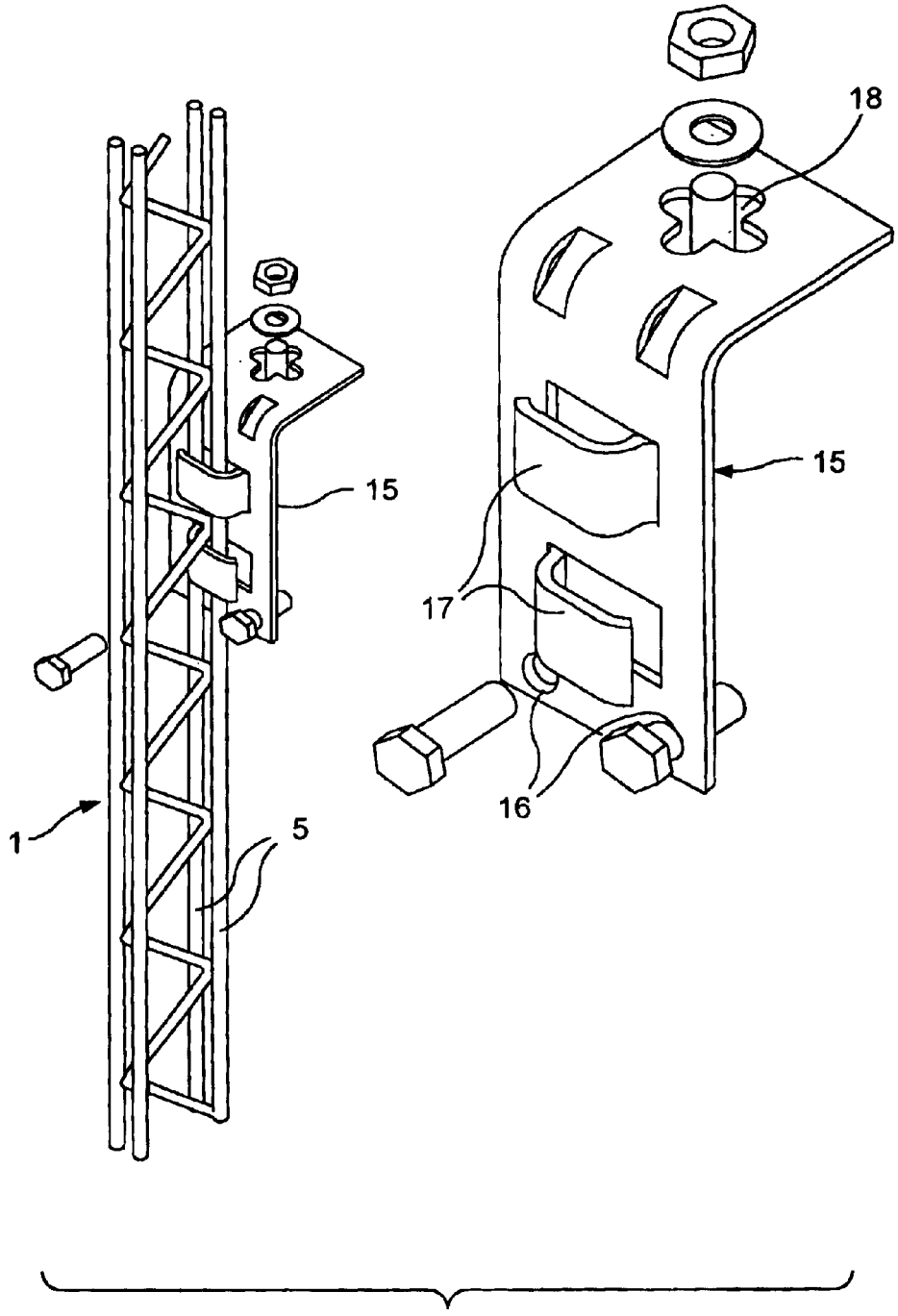
FIG. 7*a*.—Shows the perspective of a further type of lateral anchor which may be employed on the reinforcement shown in the previous figure.

This form of anchor (12) is merely illustrated by way of example, as the said anchors may also be made by angle plates (15) provided with cut out sections (16) which may be bolted to any suitable surface These plates (15) are provided with punched offset flanges (17) designed to hold the bar (5) of the reinforcement (1), it being possible to include an additional end housing (18) which will allow the angle plate (15) to be fixed to a horizontal support instead of a vertical surface, as shown in FIG. 7*a*.

Figure 7B:
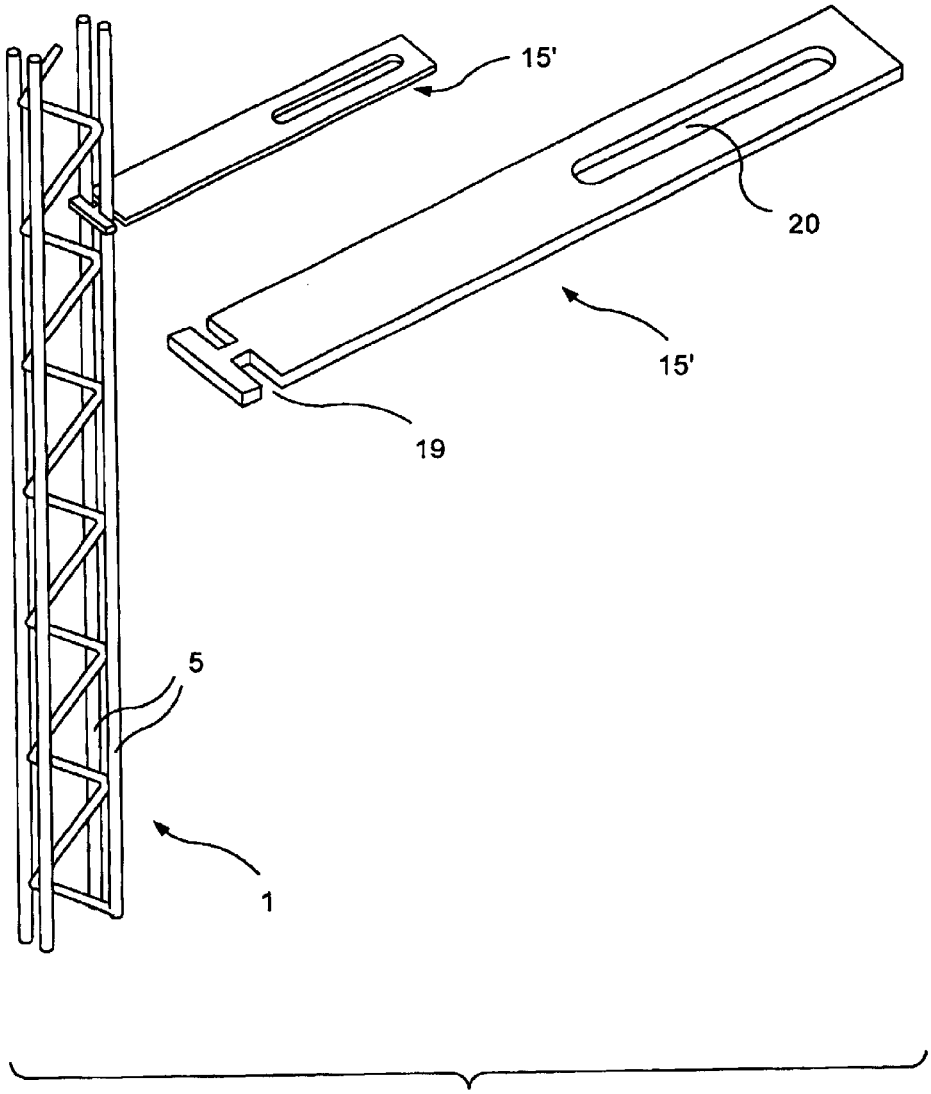
FIG. 7*b*.—Shows a further example of lateral anchor for the same type of reinforcement as in the previous figure.

A further possibility is shown in FIG. 7*b*, here the aforementioned angle (15) is replaced by an anchor plate (15'), this being a flat rectangular plate which lies horizontally and is simply fixed to the two vertical bars (5) of the reinforcement (1) by way of two notches stamped in the end of the plate in the form of a "T". The said plate (15') is also provided with a longitudinal slot (20') which allows it to be fixed to a floor slab or horizontal surface as required.

Figure 8A:
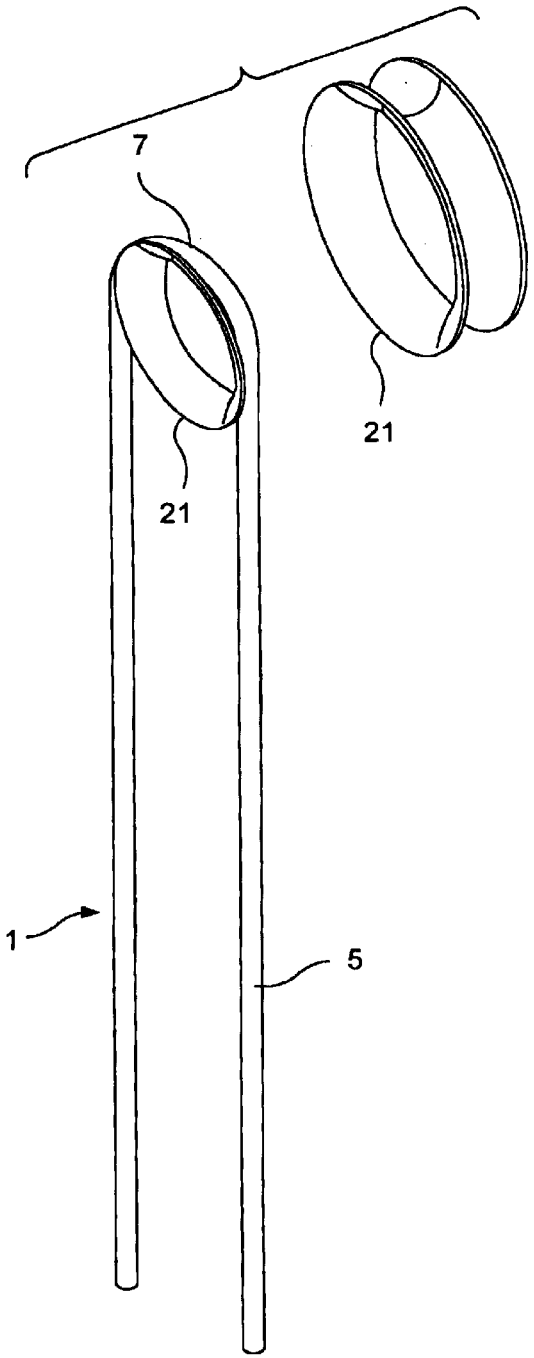
FIG. 8*a*.—Shows the perspective of an end anchor which has been suitably fixed to the corresponding void reinforcement.
Figure 8B:
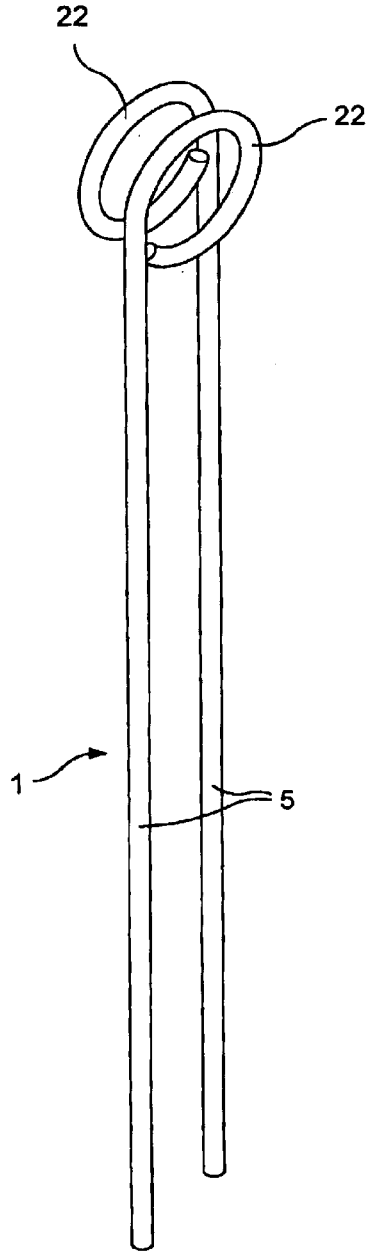
FIG. 8*b*.—Shows a variation in the form of end anchorage, on this occasion formed by bending the ends of the reinforcement itself.

The reinforcement (1) may also be connected at the ends, as is illustrated by the anchor (21) shown in FIG. 8*a*. This anchor consists of an externally notched sleeve or ring which houses the semi-circular upper section (7) closing the ends of the two bars (5) to the reinforcement. The said sleeve (21) may be provided with two parallel circumferential notches for double reinforcing bars, or may simply be made in the form of a cylinder.

However, the ends of reinforcing bars themselves (5) may be looped (22) to form an anchorage in place of the ring (21), thereby eliminating the need for any additional element and subsequently be held by any suitable horizontal support.

Figure 8C:
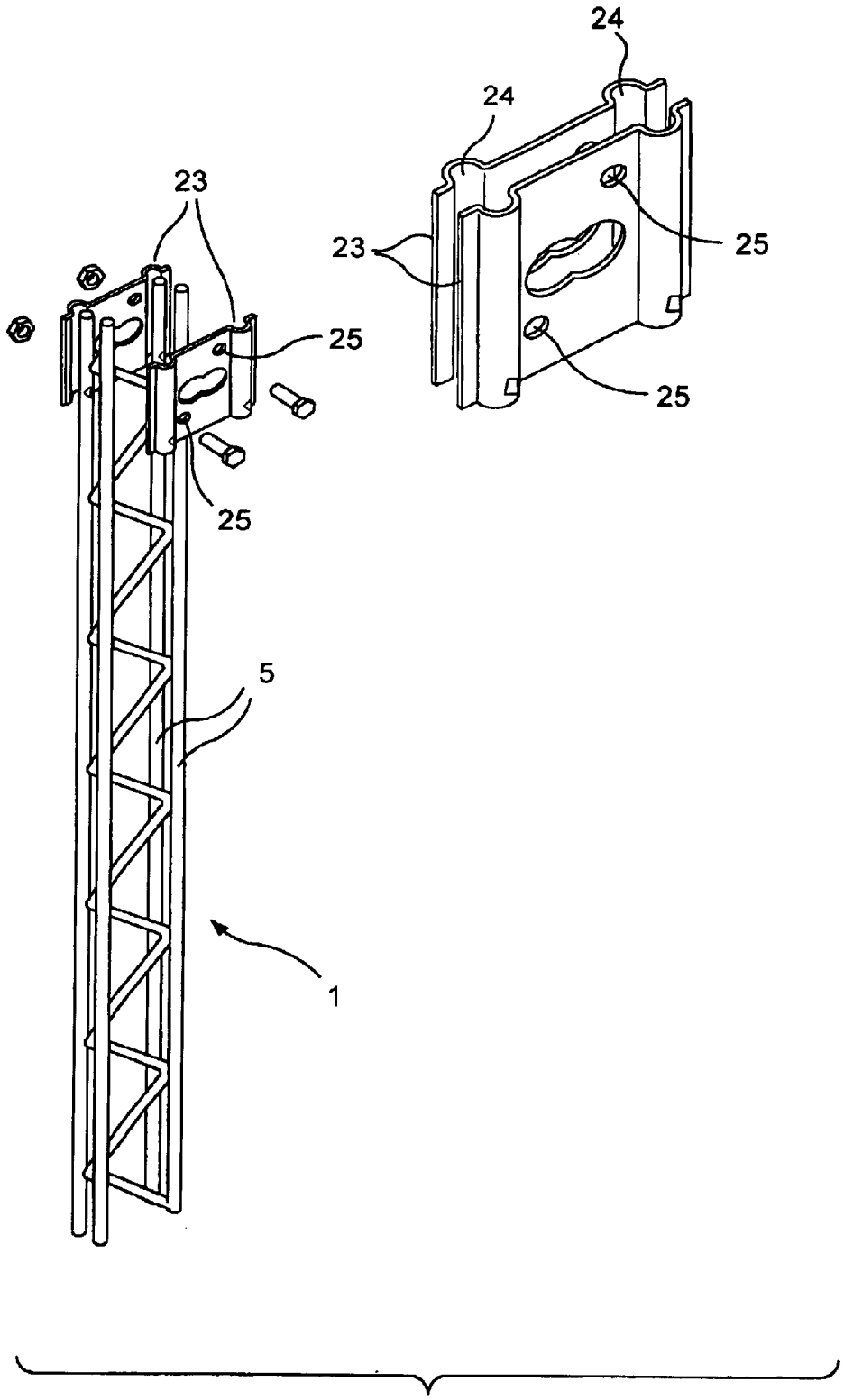
FIGS. 8*c* and 8*d*.—Show two further forms of end anchor attached to the reinforcement.

FIG. 8*c* shows another solution for end anchorage of reinforcement (1), in which a set of plates (23) are provided with moulded forms and notches (24) to enable their positioning on the reinforcing bars (5), the said bars are tightly cramped and gripped to the anchor by bolts passing through the bolt holes (25) in each plate and tightened by nuts to connect the respective plates.

Figure 8D:
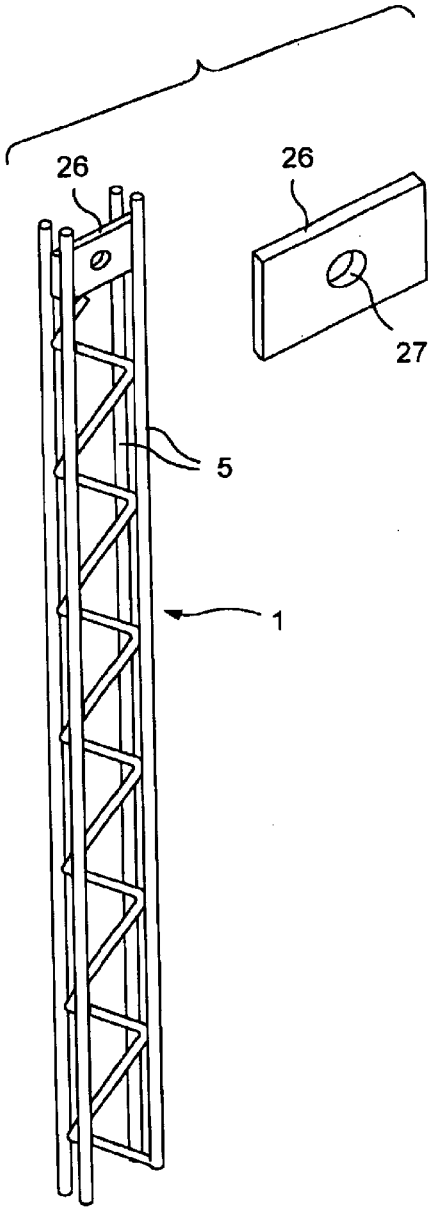

A simpler solution is indicated in FIG. 8*d*, where a plane flat or plate (26) is welded to the upper end of the reinforcement (1), in this example, between the double bars (5) of the same. The said plate (26) is drilled (27) to allow fastening to a suitable support.

Figure 8E:
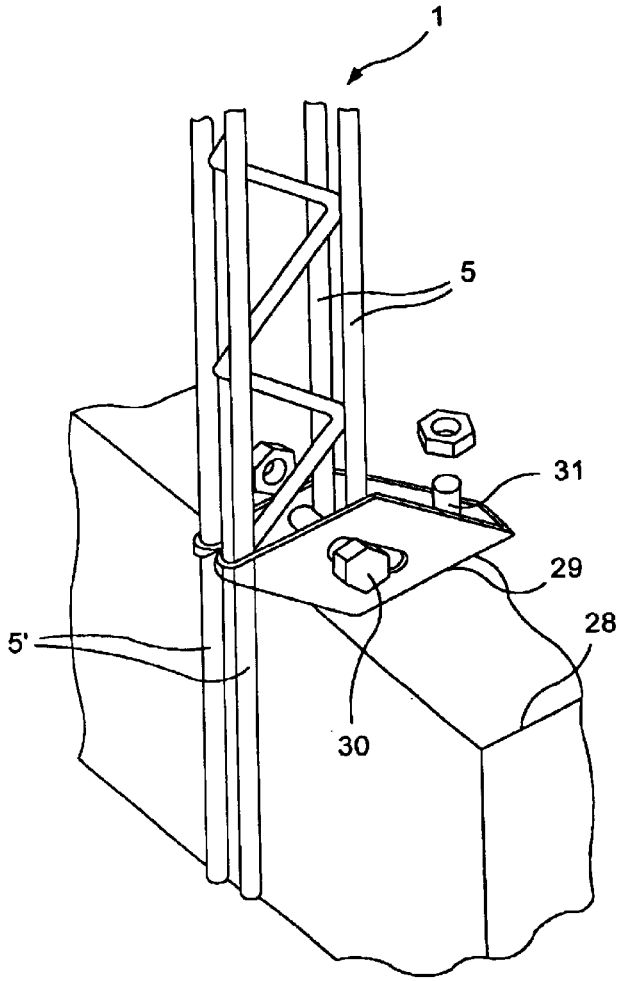
FIGS. 8*e* and 8*f*.—Show two further methods of forming the said end anchor which in addition to being fixed to the reinforcement, are also fixed to the slab or support face in FIG. 8*e* the anchor being fixed at its lower end and in FIG. 8*f* attached at the upper end.

In the variation shown in FIG. 8*e*, the anchorage to the reinforcement (1) is made at the lower end of the same, in such a way that the double reinforcing bar (5) is set on the surface of the floor slab while the longer reinforcing bar (5') is set against the side of the same, the said reinforcement (1) being fixed in position by way of a bracket (29) which clamps the reinforcement and is bolted together (30) and then, in turn, fixed to the floor slab (28) by a threaded pin (31) as illustrated in the said figure.

Figure 8F:
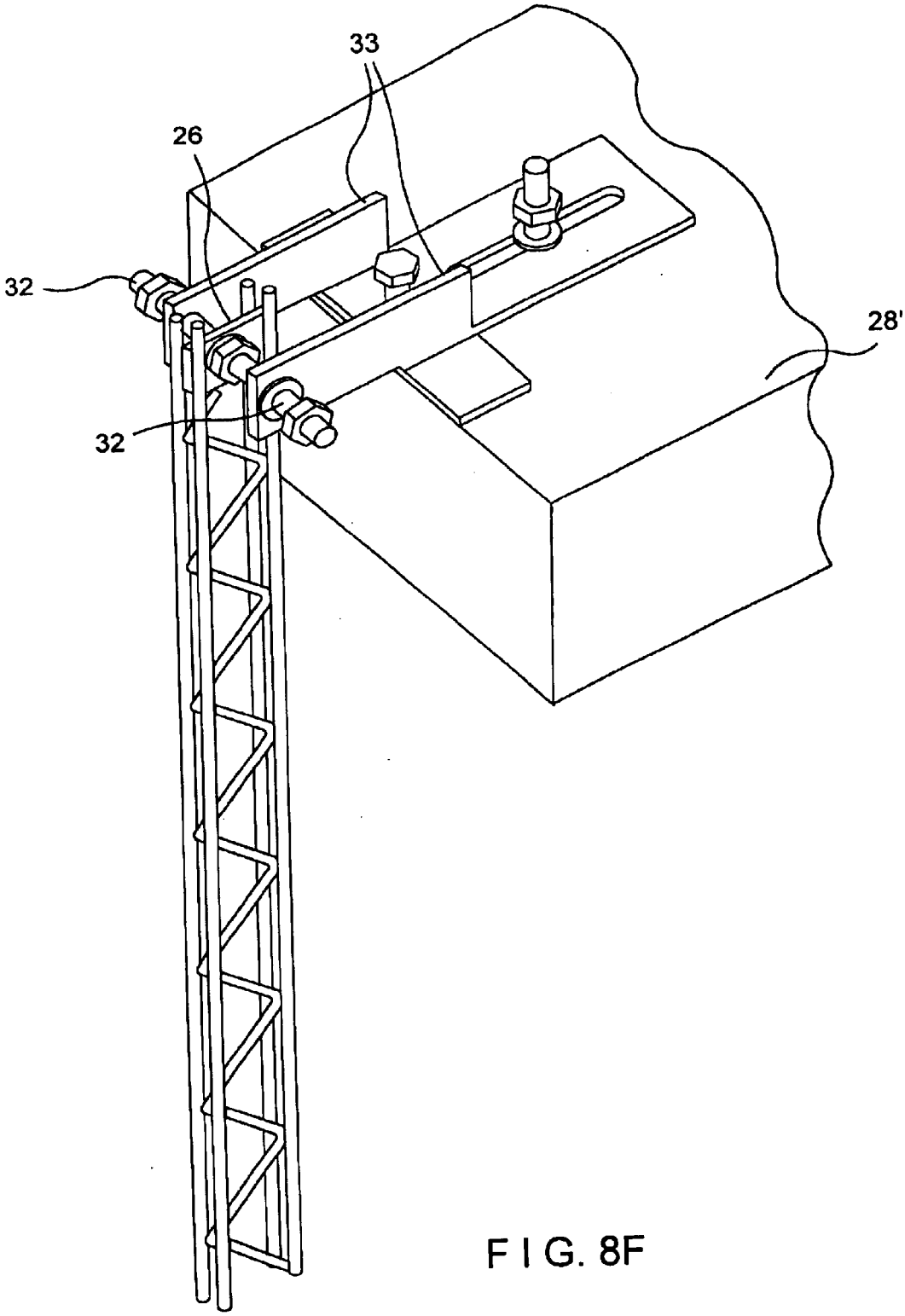

When returning to the upper anchorage of the reinforcement (1) and continuing from the structural example given in FIG. 8*d*, where the reinforcing bars are connected by a welded and drilled plate (26), it is then possible to pass a threaded pivot (32) which may be positioned by sleeves, nuts and washers in order to receive a sliding bracket (33) set on the floor slab, as indicated in FIG. 8*f*.

Figure 9:
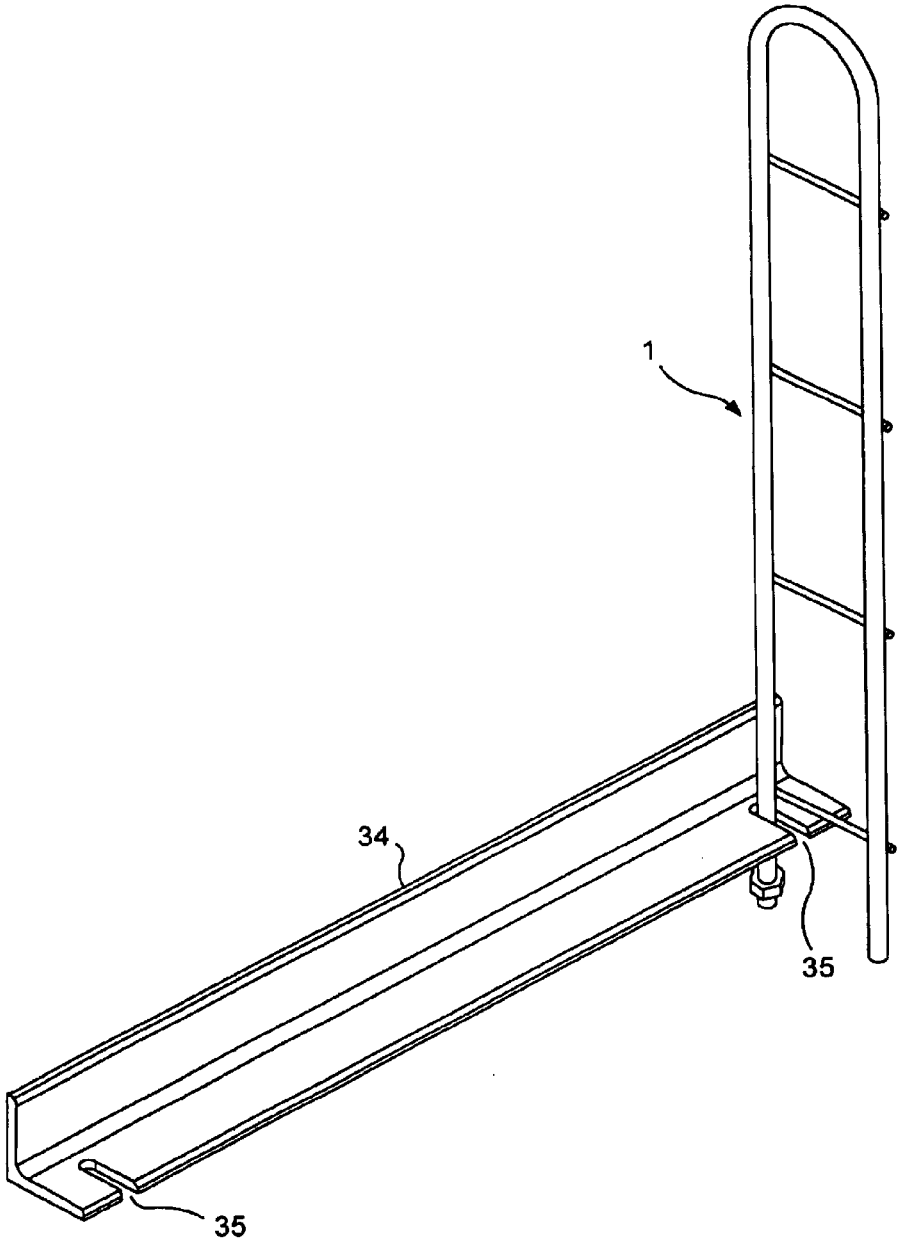
FIG. 9.—Shows the perspective of a supplementary element, in this case, the starting support profile for the base of overhanging masonry.

The system is then completed with the said supplementary elements, such as the support profile (34) shown in FIG. 9 which is designed to slot on to the reinforcement (1) by way of horizontal grooves (35) set into the lower section of the profile, thereby allowing the said profile (34) to serve as the starting support for overhanging brick or blockwork. Other supplementary elements include; retention anchors for rising parapets of balconies or roofs; hanging brackets which may serve to support the housing for blinds or other window coverings; and plumb and levelling lines particularly in the manual erection of the brick or blockwork, and which obviously allow for adjustment within the direction of the three axes of the wall.

Figure 10:
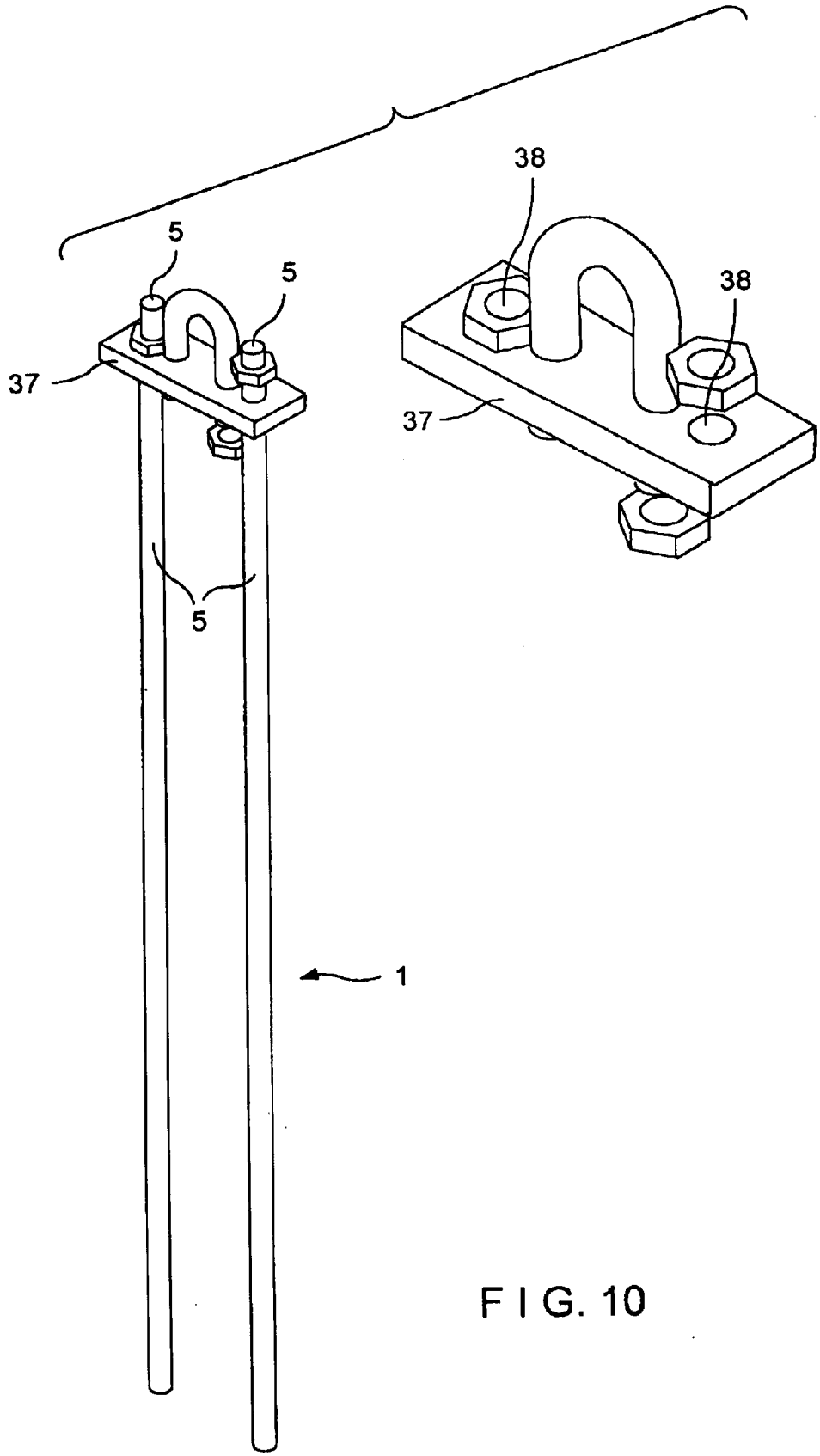
FIG 10.—Shows a type of end anchor which is bolted to the longitudinal bars.

FIG. 10 shows a type of end anchorage where the longitudinal bars (5) of reinforcement (1) are bolted to an anchor plate (37) through perforations (38).

Finally, this system also allows the prefabrication of void reinforcement using only one component, and therefore one material unit. In this case there is no difference between the connectors and the vertical reinforcement. This would include plates bent to form open or closed sections, with plate of greater or lesser gauge and draw. Double reinforcement may be "U" shaped, cross the void in the form of an "X", or vertically overlap, as in the traditional form of bars in reinforced concrete, in order to give longitudinal continuity to the reinforcement.

It is not considered necessary to prolong this description as any expert in the field will immediately comprehend the scope of the invention and the advantages that may be derived from the same.

The materials, shape, size and positioning of the elements will be susceptible to change providing that this does not affect the essence of the invention.

The terminology employed in this statement should be taken in the broadest sense and not only restricted to the same.

What is claimed is:

1. An integral reinforcing system for a masonry wall comprising longitudinal reinforcement members transverse connectors joining the longitudinal reinforcers within a plane of the vertical reinforcement or a side of the masonry wall, wherein the connectors are formed from plates angled at each end with a longitudinal cut in each angle dividing each end into sections offset asymmetrically, and each end has an internal notch in the longitudinal cut for engaging and enclosing a portion of the longitudinal reinforcement members therein.

2. A masonry wall having a void therein and a wall reinforcing system secured within said void, said system comprising first and second elongated members, and at least one transverse connector secured to each of said first and second elongated members to fix the first and second elongated members in a substantially parallel, spaced apart position from one another, said spaced apart position being sufficient to stabilize the masonry wall wherein the transverse connector is a plate (8) having first and second ends, each end having a notch therein forming two offset asymmetric spaced apart end portions and wherein each elongated member is secured within the notch at each respective end of the transverse connector.

3. A reinforcing system for a masonry wall comprising first and second elongated members, and at least one transverse connector secured to each of said first and second elongated members to fix the first and second elongated members in a substantially parallel, spaced apart position from one another, said system being sized for fitting within a void in a masonry wall, the spaced apart position being sufficient to stabilize the wall wherein the transverse connector is formed from a plates (8) having first and second ends, each end having a notch therein forming two offset asymmetric spaced apart end portions and wherein each elongated member is secured within the notch at each respective end of the transverse connector.

* * * * *